US009731870B2

(12) United States Patent
Vogel et al.

(10) Patent No.: US 9,731,870 B2
(45) Date of Patent: Aug. 15, 2017

(54) RETORT CLOSURE FOR A CONTAINER

(71) Applicant: Gateway Plastics, Inc., Mequon, WI (US)

(72) Inventors: William C. Vogel, Mequon, WI (US); Terrence M. Parve, Menomonee Falls, WI (US)

(73) Assignee: GATEWAY PLASTICS, INC., Mequon, WI (US)

( * ) Notice: Subject to any disclaimer, the term of this patent is extended or adjusted under 35 U.S.C. 154(b) by 131 days.

(21) Appl. No.: 14/602,532

(22) Filed: Jan. 22, 2015

(65) Prior Publication Data

US 2016/0214767 A1 Jul. 28, 2016

(51) Int. Cl.

| | |
|---|---|
| ***B65D 41/04*** | (2006.01) |
| ***B65D 1/02*** | (2006.01) |
| ***B65B 7/28*** | (2006.01) |
| ***B65D 51/16*** | (2006.01) |

(52) U.S. Cl.

CPC ..... *B65D 41/0428* (2013.01); *B65B 7/2842* (2013.01); *B65D 1/023* (2013.01); *B65D 41/045* (2013.01); *B65D 41/0485* (2013.01); *B65D 51/1611* (2013.01)

(58) Field of Classification Search

CPC B65D 41/0428; B65D 51/1611; B65D 1/023; B65D 41/0485; B65D 41/045; B65B 7/2842

USPC ..... 215/232, 329, 307; 220/258.1, 258.2, 220/367.1, 303

See application file for complete search history.

(56) References Cited

U.S. PATENT DOCUMENTS

| | | | | |
|---|---|---|---|---|
| D30,094 | S | 1/1899 | Busch | |
| 2,920,778 | A | 12/1960 | Foye | |
| 3,926,348 | A * | 12/1975 | Lutzker | B65D 47/121 222/189.07 |
| 4,111,322 | A * | 9/1978 | Obrist | B65D 41/02 215/230 |
| 4,643,330 | A | 2/1987 | Kennedy | |
| D315,309 | S | 3/1991 | Baughman | |
| D321,325 | S | 11/1991 | Petrus | |
| 5,197,619 | A | 3/1993 | Margaria | |
| D338,621 | S | 8/1993 | Balson | |
| D348,836 | S | 7/1994 | McCallum et al. | |
| 6,202,871 | B1 * | 3/2001 | Kelly | B65D 41/3423 215/307 |
| 6,276,543 | B1 * | 8/2001 | German | B65D 41/3409 215/252 |
| 6,729,487 | B1 | 5/2004 | Dischler | |
| D516,911 | S | 3/2006 | Bloom et al. | |
| D576,878 | S | 9/2008 | Brashear | |
| D584,149 | S | 1/2009 | Lohrman et al. | |
| 7,735,763 | B2 | 6/2010 | Bell et al. | |
| D619,003 | S | 7/2010 | Benoit-Gonin et al. | |
| D679,598 | S | 4/2013 | Miceli et al. | |
| D679,999 | S | 4/2013 | Miceli et al. | |
| D680,002 | S | 4/2013 | Miceli et al. | |

(Continued)

*Primary Examiner* — James N Smalley

(74) *Attorney, Agent, or Firm* — Foley & Lardner LLP

(57) ABSTRACT

A closure includes a skirt defining an outer periphery of the closure and having an open bottom end configured to fit over the mouth of a receptacle, an end wall positioned atop the skirt to close a top end of the skirt and form a top face of the closure, one or more openings formed through the end wall, and a sealing rib formed on the top face and diametrically disposed outboard the one or more openings.

19 Claims, 8 Drawing Sheets

(56) References Cited

U.S. PATENT DOCUMENTS

| | | | | |
|---|---|---|---|---|
| D681,465 | S | 5/2013 | Cox et al. | |
| D693,221 | S | 11/2013 | Ramsey et al. | |
| D693,685 | S | 11/2013 | Ramsey et al. | |
| D694,901 | S | 12/2013 | Hohl et al. | |
| D722,689 | S | 2/2015 | Miceli et al. | |
| 2005/0284837 | A1* | 12/2005 | Taber | B65D 51/145 215/276 |
| 2007/0034593 | A1* | 2/2007 | Ichimura | B65D 41/045 215/307 |
| 2008/0302752 | A1 | 12/2008 | Farrar et al. | |
| 2009/0039086 | A1* | 2/2009 | Auer | A47J 36/027 220/367.1 |
| 2012/0285959 | A1* | 11/2012 | Ekkert | B65D 79/005 220/243 |
| 2014/0263149 | A1 | 9/2014 | Berge et al. | |
| 2016/0023795 | A1 | 1/2016 | Itzhaki | |
| 2016/0214767 | A1 | 7/2016 | Vogel et al. | |

* cited by examiner

RETORT CLOSURE FOR A CONTAINER

FIELD

The present disclosure relates to a closure for a container for storing materials (e.g., food products, liquids, etc.). The present disclosure more specifically relates to a closure having apertures for expelling materials and other debris from underneath the closure when coupled to a container.

BACKGROUND

This section is intended to provide a background or context to the subject matter recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

A cover or closure may be provided on a container used for storing and dispensing a liquid or other materials, particularly food products and medicinal products such as those that are displayed and sold in stores. The closure may include a liner that forms an airtight seal against the mouth of the container to guard against oxygen ingress. For instance, the container may be filled with a product, such as a food product, etc., through an open mouth of the container. The closure may then be coupled to the container to cover the open mouth. When a heat source is applied to the closure, the liner releases from the closure and forms an airtight seal over the open mouth of the container. However, once the container is sealed, excess (e.g., dried) product (or other contaminants or debris) may remain between the closure and the container (e.g., on a neck of the container, such as along threads between the container neck and the closure). The excess product may be trapped between the closure and the neck of the container such that the excess product cannot be wiped away without removing the closure or is not seen until closure removal by the end customer.

SUMMARY

An embodiment of the present disclosure relates to a closure configured to fit over a mouth of a receptacle to form a container. The closure includes a skirt defining an outer periphery of the closure and having an open bottom end configured to fit over the mouth of the receptacle, an end wall positioned atop the skirt to close a top end of the skirt and form a top face of the closure, one or more openings formed through the end wall, and a sealing rib formed on the top face and diametrically disposed outboard the one or more openings.

Another embodiment of the present disclosure relates to a closure configured to fit over a mouth of a receptacle to form a container. The closure includes a skirt defining an outer periphery of the closure and having an open bottom end configured to fit over the mouth of the receptacle, an end wall positioned atop the skirt to close a top end of the skirt, the end wall having a first side forming a top face of the closure and a second side forming an inner surface, one or more openings formed through the end wall, an induction liner substantially covering the inner surface and configured to detach from the inner surface to hermetically seal the mouth of the receptacle when the closure is coupled to the receptacle and adequate heat is applied to the induction liner, and a sealing rib formed on the top face and diametrically disposed outboard the one or more openings.

Another embodiment of the present disclosure relates to a container for storing dispensable contents. The container includes a receptacle having a neck forming an open mouth, and a closure removably coupled to the receptacle to substantially cover the open mouth. The closure includes a skirt defining an outer periphery of the closure and having an open bottom end configured to fit over the mouth of the receptacle, an end wall positioned atop the skirt to close a top end of the skirt and form a top face of the closure, one or more openings formed through the end wall, an induction liner removably attached to the end wall and configured to hermetically seal the open mouth of the receptacle when adequate heat is applied to the induction liner, and a sealing rib formed on the top face and diametrically disposed outboard the one or more openings.

Another embodiment of the present disclosure relates to a method of sealing a container. The method includes filling a receptacle with dispensable contents, wherein the receptacle has a neck forming an open mouth, coupling a closure to the receptacle to substantially cover the open mouth, wherein the closure includes a skirt defining an outer periphery of the closure and having an open bottom end, an end wall positioned atop the skirt to close a top end of the skirt and form a top face of the closure, one or more openings formed through the end wall, an induction liner removably attached to the end wall, and a sealing rib formed on the top face and being disposed diametrically outboard the one or more openings, wherein the closure is coupled to the receptacle such that the one or more openings are disposed at least partially diametrically outboard of an outer edge of the open mouth, sealing the open mouth by detaching the induction liner from the closure, engaging an air source to the sealing rib of the closure to form an airtight seal between the air source and the sealing rib, and using the air source, forcing air through the one or more openings to an air passage formed between the skirt and the neck of the receptacle and out the open bottom end of the closure.

DETAILED DESCRIPTION

Figure 1:
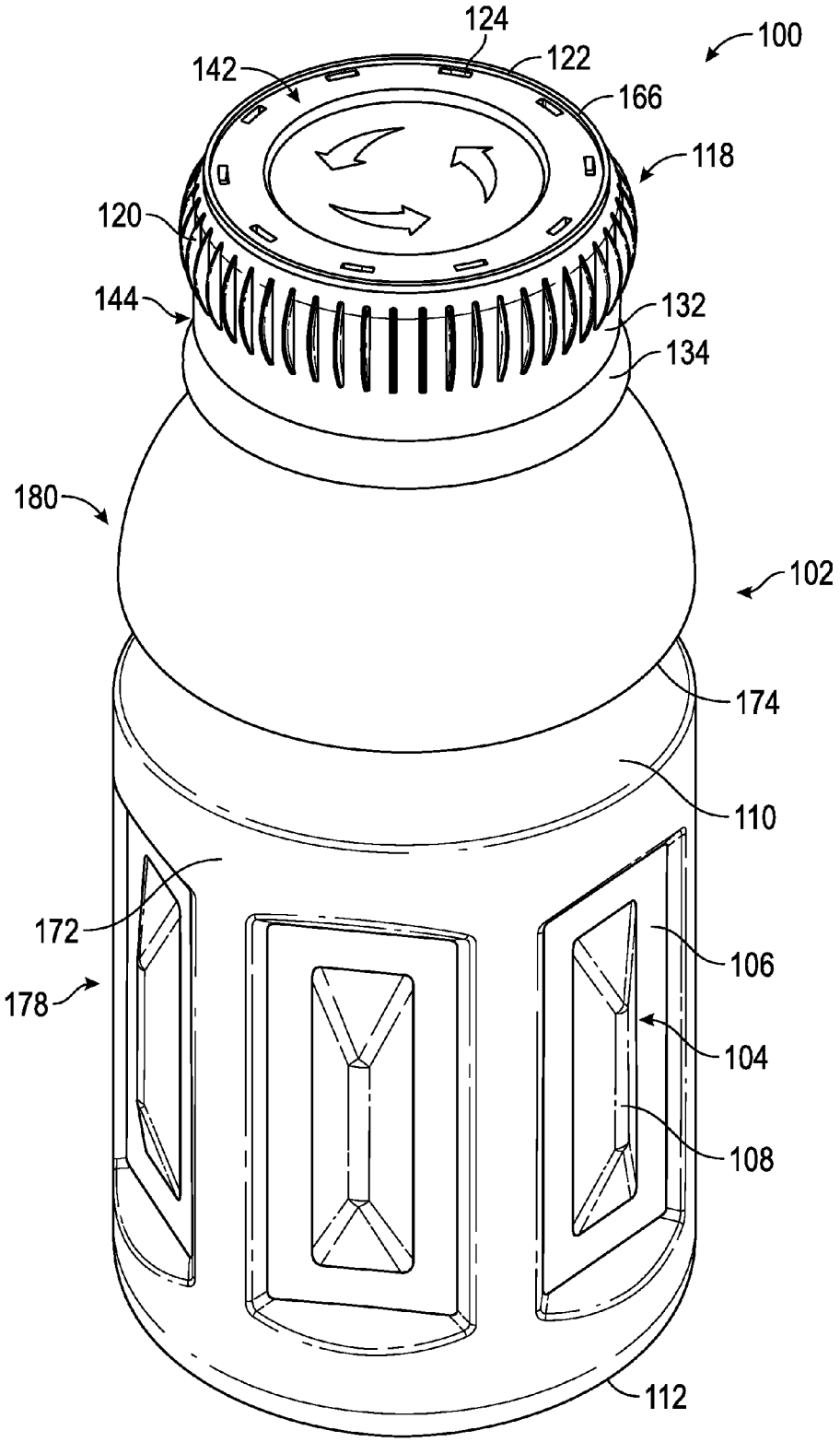
FIG. 1 is a perspective view of a container having a closure, according to an example embodiment.
Figure 2:
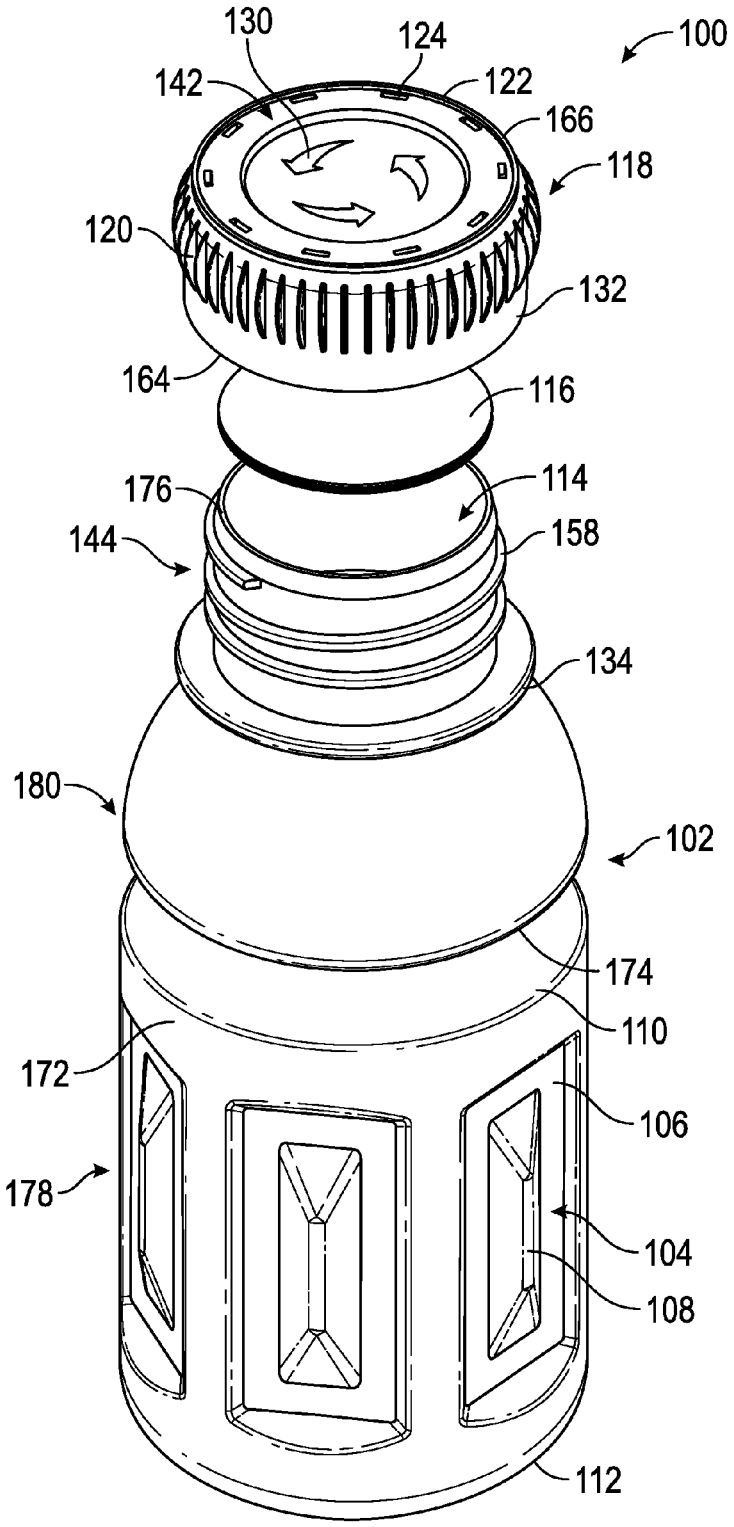
FIG. 2 is an exploded perspective view of the container, according to an example embodiment.
Figure 3:
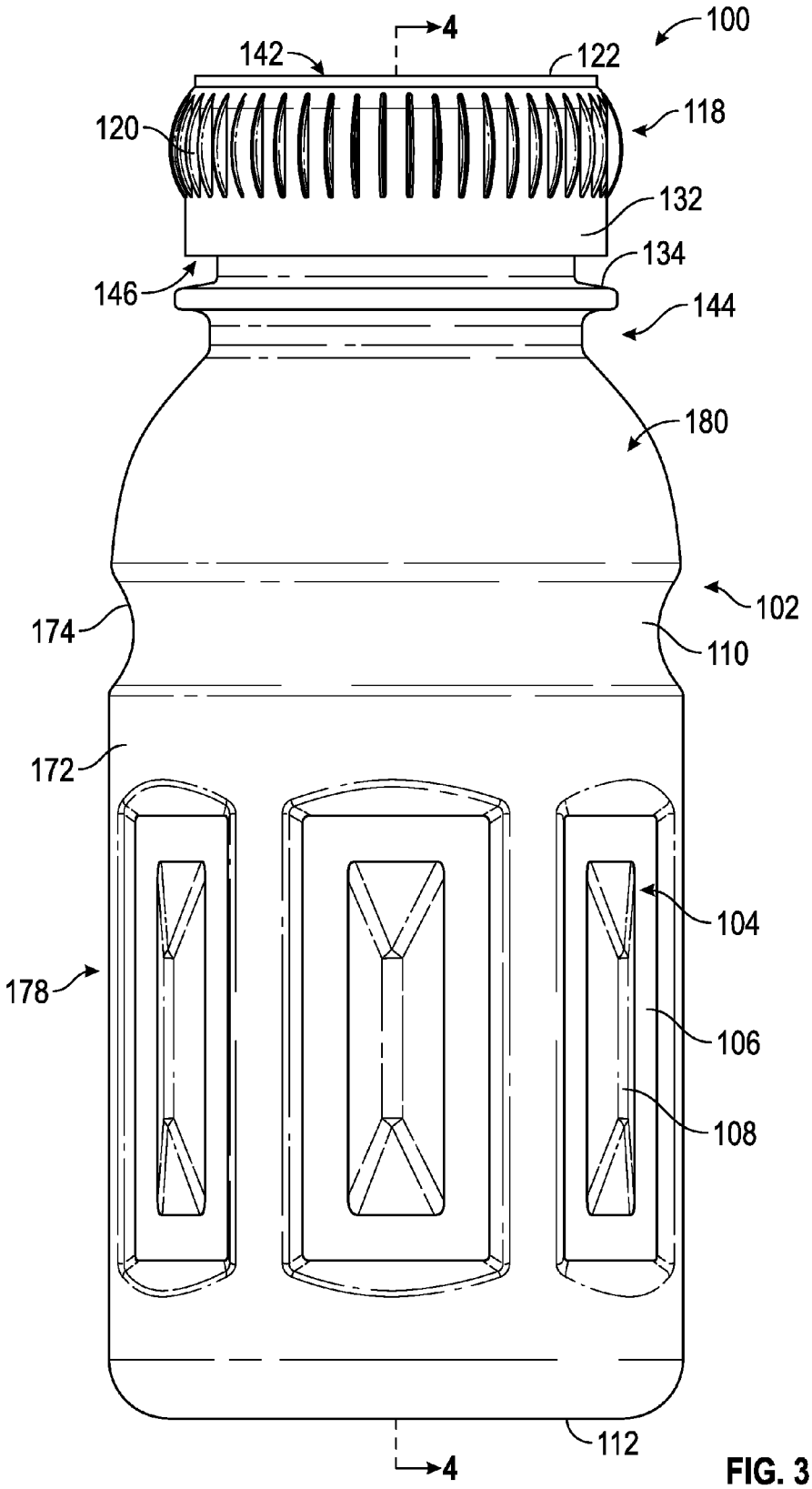
FIG. 3 is a front plan view of the container, according to an example embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to FIGS. 1 through 4, a container 100 of the present disclosure is shown, according to an exemplary embodiment. In this embodiment, the container 100 includes a receptacle shown as a bottle 102 having an open mouth 114 (shown in FIG. 2) for filling and accessing the contents of a product stored within the bottle 102. The container 100 is intended to be used to store a liquid product, such as a liquid or semi-liquid food product, but may also be used to store other types of products (e.g., powders, pellets, pills, etc.). The container 100 is also shown to include an induction liner 116 (shown in FIG. 2 and more particularly in FIG. 6) that fits over the open mouth 114 to seal the mouth 114 and protect the contents stored within the bottle 102, as well as a closure 118 that fits over the mouth 114 and the liner 116 to protect the liner 116 and further protect the contents stored within the bottle 102. In an example embodiment, the bottle 102 and the closure 118 may be made from polypropylene or another plastic material. The liner 116 may be made from a combination of materials, as is described in relation to FIG. 6 below.

The bottle 102 is shown to include an approximately cylindrical body 178 extending from a bottom surface 112 (i.e., base, basal edge) of the bottle 102. The body 178 is formed by a smooth outer surface 172 and includes grip features 104 spaced intermittently within the outer surface 172 and positioned around a circumference of the body 178 in order to provide additional gripping surfaces for the bottle 102. The grip features 104 include a recessed portion 106 that is recessed from the outer surface 172 of the bottle 102 and a raised portion 108 within the recessed portion 106. The raised portion 108 and the recessed portion 106 may provide additional frictional surfaces for a user to grip the bottle 102 (and thus the container 100), such as when removing the liner 116 and/or the closure 118. In an example embodiment, the radius of the body 178 at the raised portion 108 is approximately equal to the radius of the body 178 at the outer surface 172. The body 178 may have an approximately uniform diameter at the outer surface 172.

Still referring to FIGS. 1 through 4, the body 178 extends from the bottom surface 112 to an annular groove 110 formed around the circumference of the bottle 102. The annular groove 110 is recessed from the outer surface 172, having a smaller diameter than the body 178 at the outer surface 172. The annular groove 110 is rounded to provide a shelf 174 (i.e., ledge) for grasping the bottle 102. The annular groove 110 may be sized or shaped to receive a finger of a user of the container 100. The bottle 102 also includes a shoulder 180 extending from the annular groove 110 to a neck 144 (shown in FIG. 2) of the bottle 102. The shoulder 180 has a conic shape and decreases in diameter from the annular groove 110 to the neck 144. A bottom portion of the shoulder 180 may have a diameter approximately equal to a top portion of the body 178. The annular groove 110 is also recessed from the shoulder 180. For instance, the shelf 174 may be formed by a slope connecting the annular groove 110 and the shoulder 180. The neck 144 extends from the shoulder 180 to the mouth 114 of the bottle 102 and includes threads 158 configured to mate with corresponding threads of the closure 118 to couple the closure 118 to the bottle 102. It should be noted that although the bottle 102 and many of its features are shown to have a cylindrical or circular shape, in other embodiments the bottle 102 and any of its features or components may have another shape depending on the particular application of the container 100. For instance, the container 100 may include a rectangular tub rather than bottle 102 and any of the associated features may be configured likewise.

The liner 116 is adhered to the bottle 102 over the mouth 114 to seal the contents of the container 100. The liner 116 may provide a hermetic (i.e., airtight) seal for the product stored within the bottle 102 such that the product is impervious to gases (e.g., oxygen), moisture, and other contaminants. The liner 116 may be adhered to the bottle 102 as part of a manufacturing process once the bottle 102 has been filled. The liner 116 is then removable to access the contents of the container 100. In an example embodiment, the liner 116 has a one-time use and may not be re-applied. In this embodiment, presence of the liner 116 may provide an indication that the product within the bottle 102 is hermetically sealed and has not been contaminated. A hermetic seal at the mouth of the bottle 102 may be particularly important when the container 100 is used to store food products or medicines in order to indicate to the end user that the product is safe for consumption. It may also be desirable to prevent similar product from collecting at the neck 144 of the bottle 102, or otherwise underneath the closure 118, in order to present a hygienic appearance to the consumer of the product.

The liner 116 may include one or more tabs for removing the liner 116. For instance, the liner 116 may include a plurality of tabs located around the circumference of the liner 116 for ease of removal. The liner 116 may also include a pull tab that is extendable perpendicular to the horizontal surface of the liner 116 in order to pull and remove the liner 116 from the bottle 102. In the illustrated embodiment shown in FIG. 2, the liner 116 has a substantially circular shape to fit the shape of the mouth 114, but may have other shapes in other embodiments according to the particular application of the liner 116 and/or the container 100. The liner 116 is described in further detail herein in reference to FIG. 6.

The closure 118 is also configured to fit over the mouth 114 in order to cover the mouth 114 and seal the contents of the container 100. The closure 118 includes threads 162 (shown in FIG. 4 and more particularly in FIG. 11) that mate with the threads 158 of the bottle 102 to couple the closure 118 to the bottle 102. The closure 118 may be rotated relative to the bottle 102 to engage the threads 158, 162 and couple the closure 118 to the bottle 102. Likewise, the closure may be rotated in an opposite direction relative to the bottle 102 to disengage the threads 158, 162 and release the closure 118 from the bottle 102.

Figure 4:
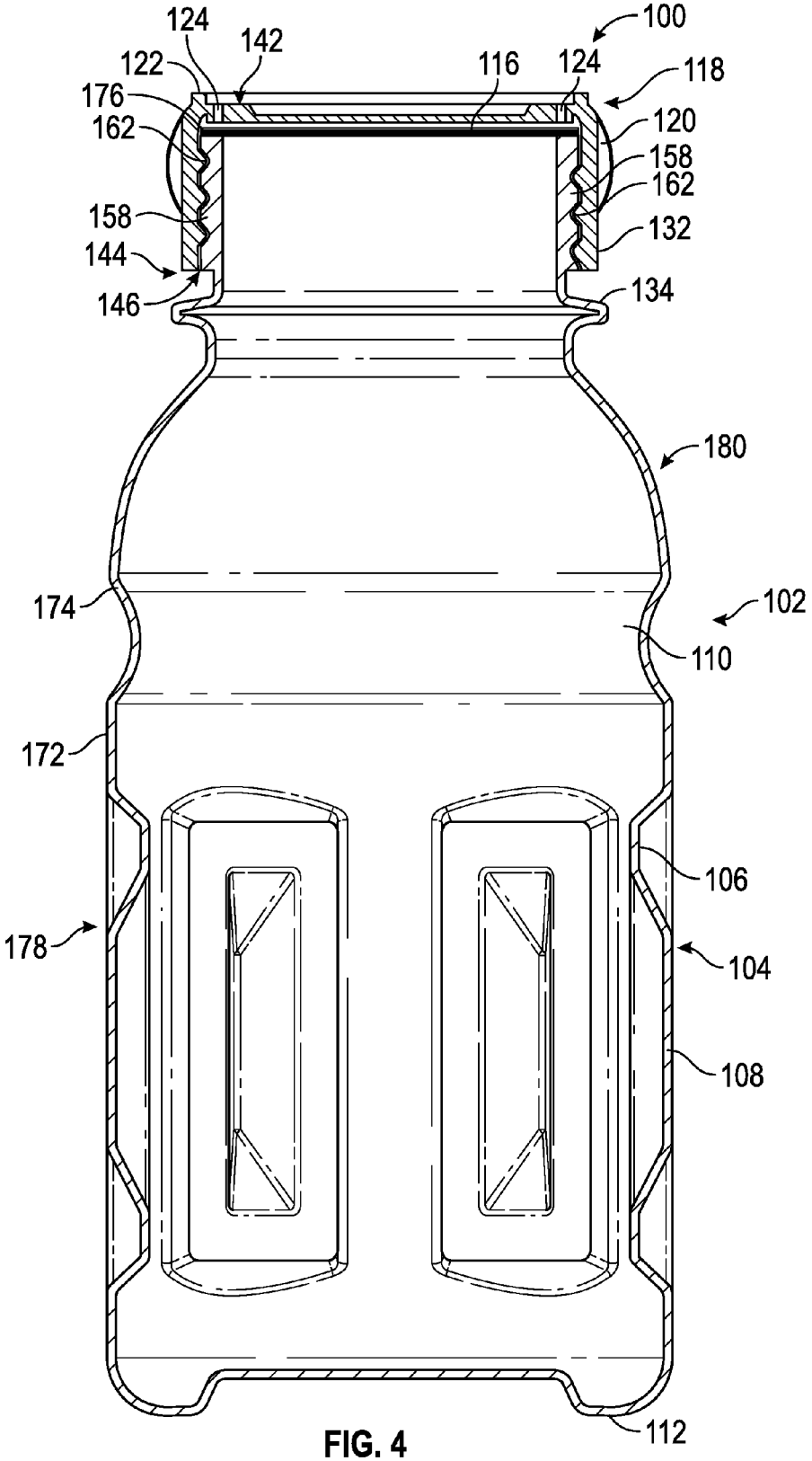
FIG. 4 is a cross-sectional view of the container along the 4-4 line of FIG. 3, according to an example embodiment.

In an example embodiment, the closure 118 is utilized to adhere (i.e., seal) the liner 116 to the bottle 102 (i.e., over the mouth 114) by an induction sealing process. In this embodiment, the liner 116 is inserted within or otherwise included as part of the closure 118 prior to being adhered to the bottle 102. For instance, a first side of the liner 116 (e.g., layer 148 shown in FIG. 6) may be adhered (e.g., spot-glued) to an inner surface 184 of the closure 118 (shown in FIG. 9) by a first adhesive. The closure 118 may then be coupled to the bottle 102 via the threads 158, 162 (as shown in FIG. 4), such that the liner 116 is positioned over the mouth 114. Once the closure 118 is coupled to the bottle 102, heat may be applied to the liner 116 (e.g., via an electromagnetic field applied by an induction coil, etc.), causing the first adhesive to melt and the liner 116 to be released from the inner surface 184 of the closure 118. When the heat is applied to the liner 116, a second adhesive on a second and opposite side of the liner 116 (i.e., the side facing the mouth 114) may be heated, causing the second adhesive to flow onto a lip 176 of the bottle 102 which forms the mouth 114. When cooled, the second adhesive creates a bond between the liner 116 and the bottle 102, resulting in a hermetic seal over the mouth 114. The closure 118 is then removable from the bottle 102 without removing the liner 116 from the mouth 114, maintaining the hermetic seal.

The closure 118 also includes gripping features shown as outer ribs 120 that are positioned around an outside edge of the closure 118. The ribs 120 are intended to provide grip for a user of the container 100 to open or close the container 100 by rotating the closure 118 relative to the bottle 102. In an example embodiment, the ribs 120 are substantially uniform and equally spaced around the outer perimeter of the closure 118, such that the closure 118 provides the same grip regardless of orientation. In particular, the ribs 120 are positioned vertically around an outer periphery of the closure 118 formed by the side wall 132. The ribs 120 have a rounded shape and are intended to provide frictional faces for gripping the closure 118. The frictional faces of the ribs 120 may in effect increase the radius of the closure 118 to increase an applied torque based on a designated force applied to the ribs 120 in either direction. The ribs 120 may then reduce the amount of force required to open or close the container 100 (i.e., to rotate the closure 118 relative to the bottle 102).

Referring still to FIGS. 1 through 4, the closure 118 is shown to include apertures (e.g., holes, slots, vents, ducts, flues, passages, airways, etc.) shown as openings 124 that are formed in the closure 118. The openings 124 are formed within a top face 142 (e.g., surface 136) of the closure 118 and are configured to provide an air passage from outside of the closure 118 to an area beneath the closure 118. When the closure 118 is coupled to the bottle 102 (as shown in FIG. 4), air may be forced through the openings 124 (e.g., via an air source such as fixture 200 shown in FIG. 5) from atop the closure 118 to force any remaining product or other debris out from between the closure 118 and the bottle 102 and external of the sealed liner 116. In an example embodiment, the openings 124 are located diametrically outside of the mouth 114 so that the openings 124 create an air path between the closure 118 and the bottle 102, but also permit the closure 118 to re-seal the mouth 114 after the liner 116 is removed.

In an example embodiment, pressurized air received via the openings 124 is driven past an outer edge of the liner 116 and over the neck 144 of the bottle 102, including over the threads 158 and 162 coupling the closure 118 to the bottle 102. For instance, when the bottle 102 is filled with a liquid product via the open mouth 114 and the mouth 114 is then induction sealed using the closure 118 and the liner 116, liquid product may remain on the threads 162 or 158 or otherwise between the closure 118 and the bottle 102 (e.g., due to spillage, residue, etc.). The liquid product remaining may be difficult to identify and remove due to the hidden nature of the product between the neck 144 and the closure 118, for instance. Further, depending on the nature of the product, the liquid product remaining underneath the closure 118 may spoil or harden, which may create an unpleasant or unsanitary appearance for an end user of the container 100 (despite the fact that the product remains hermetically sealed in the container 100 by the liner 116). Thus, pressurized air may be driven through the openings 124 and into an air passage 146 (e.g., area, space, etc.) between the closure 118 and the neck 144 to force any remaining product or residue out from underneath the closure 118 after the closure 118 is secured to the bottle 102. The air forced through the openings 124 may purge or remove any product remaining on the neck 144 or threads 162 and 158. Once the product is flushed from underneath the closure 118, the product may be otherwise cleaned or removed from the visible or otherwise accessible surface of the container 100. For instance, the product may be collected on a ledge 134 (e.g., collar) at the neck 144 of the bottle 102 and wiped away or otherwise cleaned from the ledge 134. In an example embodiment, the ledge 134 extends from the neck 144 to a position directly below the air passage 146 between the closure 118 and the neck 144 in order to collect the excess product forced from underneath the closure 118 via the openings 124.

The closure 118 is shown further to include a rib 122. The rib 122 is raised relative to a top face 142 of the closure 118 (i.e., surfaces 136, 138, and 140), forming a continuous outer perimeter atop the closure 118 (according to the orientation of FIG. 1) and around the top face 142 (i.e., the top surface(s)). The rib 122 has a uniform thickness and height around the top end of the closure 118 (i.e., around the perimeter of the top face 142). In other embodiments, the rib 122 may vary in size or shape according to a related feature of the closure 118 (e.g., surface 136, openings 124, etc.). The openings 124 are positioned within and below the outer perimeter formed by the rib 122 according to the upright orientation of the container 100 shown in FIG. 1.

Figure 5:
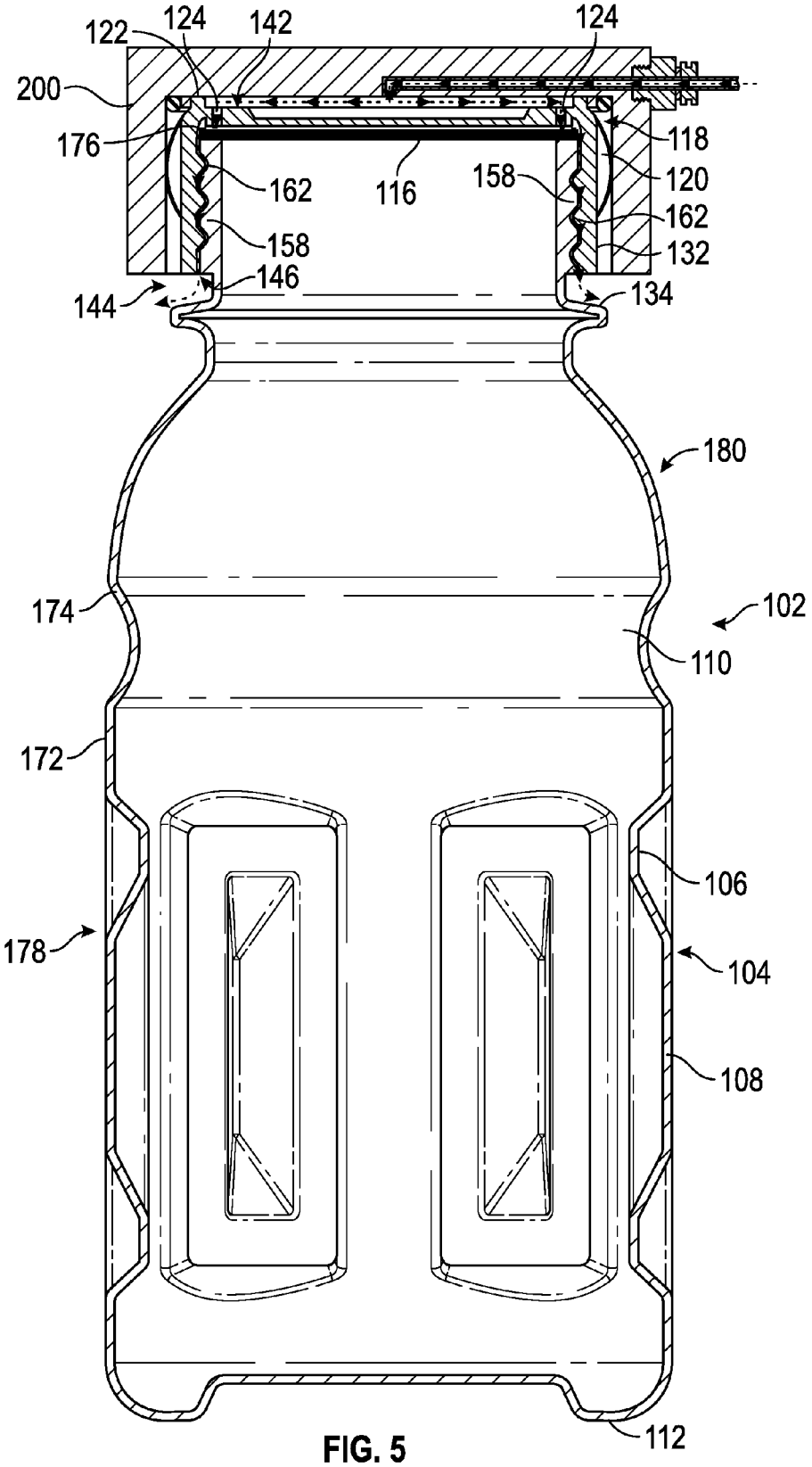
FIG. 5 is a cross-sectional view of the container attached to an air source, according to an example embodiment.

Referring now to FIG. 5, an air source shown as fixture 200 may be applied to the closure 118 to drive air through the openings 124. In the example embodiment, the rib 122 is utilized to drive pressurized air through the openings 124 and clear excess product from underneath the closure 118. The rib 122 may be configured to interact with the fixture 200 such that an airtight seal is created between the rib 122 and the fixture 200 when the fixture 200 is applied to the closure 118. Thus, any air that is delivered via the fixture 200 is forced through the openings 124 rather than escaping through an airspace between the fixture 200 and the rib 122. In the example embodiment, the fixture 200 interfaces with a flat top surface 166 of the rib 122 to create an airtight seal at the rib 122. The fixture 200 may include a component configured to receive or interface with the rib 122 to create the seal, such as a sealing ring shaped according to the rib 122. An airtight pocket may be formed in the space between the airtight seal at the rib 122 and the top surface 166 of the closure 118 (i.e., the space between the fixture 200 and the top face 142 of the closure 118).

When the fixture 200 is attached to the closure 118 (as shown in FIG. 5) to form an airtight seal, air may be driven from the fixture 200 into through the openings 124. The air is forced from the fixture 200 into the air space between the rib 122 and the fixture 200, through the openings 124, and over the liner 116. If the liner 116 includes an outer edge that extends diametrically outboard of the lip 176, the air may force the outer edge down and around the neck 144 of the bottle 102. The air is driven from the openings 124 through the air passage 146 between the closure 118 and the neck 144 (i.e., over the threads 158 and 162), and through an open bottom of the closure 118. The closure 118 is configured such that the air driven through the openings 124 forces any excess product or other material out from underneath the closure 118. The air may be driven through the air passage 146 against the ledge 134 such that any product or other material is forced from between the closure 118 and the bottle 102 and collected at the ledge 134.

Figure 6:
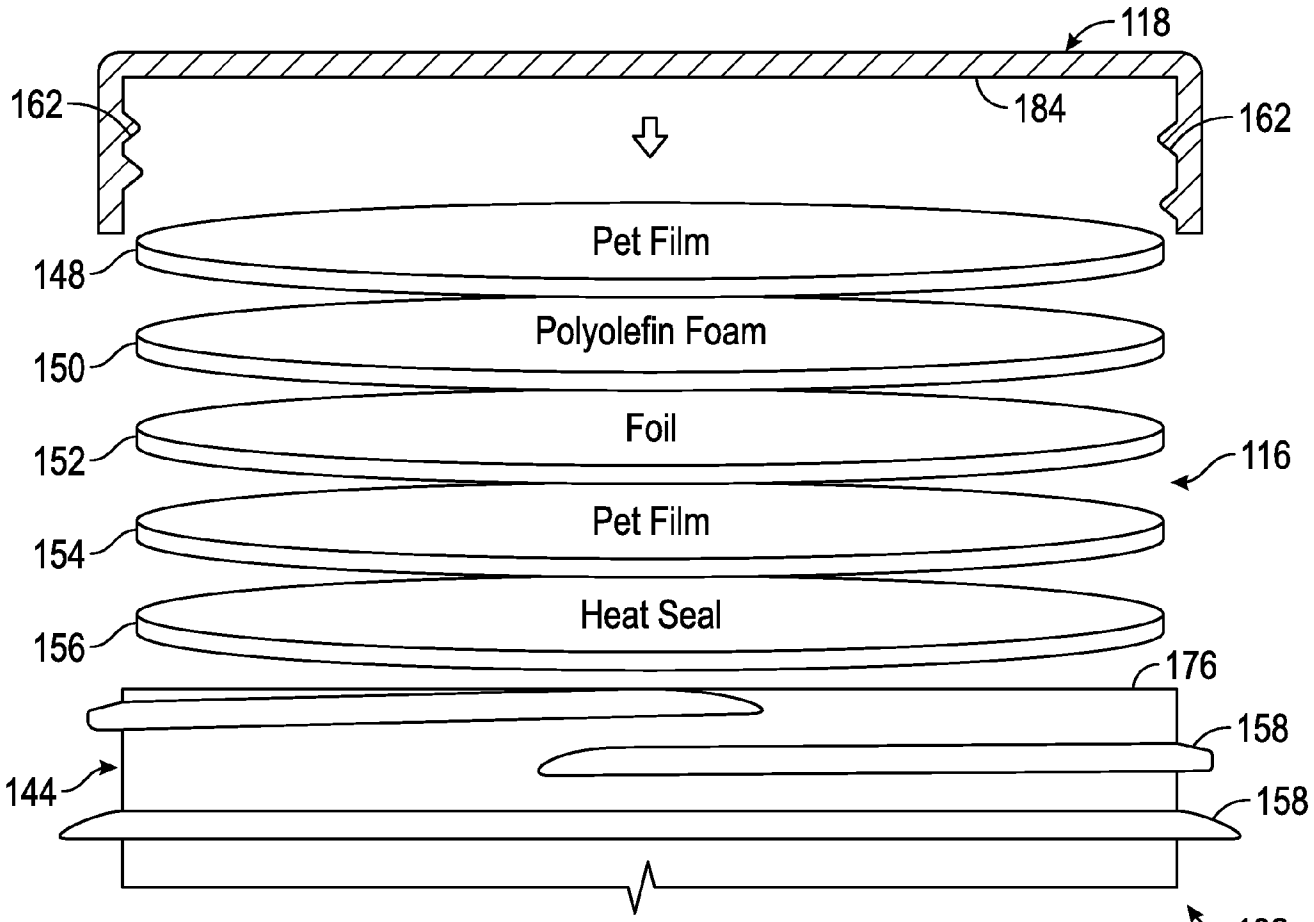
FIG. 6 is an exploded view of a sealing liner for the container, according to an example embodiment.

Referring now to FIG. 6, the liner 116 is shown, according to an example embodiment. In this embodiment, the liner 116 includes a plurality of layers. The layers of the liner 116 may each be made from a different material and have different dimensions. The layers of the liner 116 may be included as part of the liner 116 in order to provide a hermetic seal over the open mouth 114, including to adhere the liner 116 to the closure 118 or over the mouth 114. In an example embodiment, each of the layers has approximately the same circular shape, including the same radius. In the illustrated embodiment, the liner 116 includes a polyester film layer 148 intended to at least temporarily adhere the liner 116 to the inner surface 184 of the closure 118 prior to the liner 116 forming a hermetic seal over the open mouth 114. During the induction sealing process described by way of example previously, the liner 116 is heated such that the polyester film layer 148 is at least partially melted, releasing the liner 116 from the inner surface 184 allowing the liner 116 to be sealed to the lip 176 of the bottle 102 and over the mouth 114. The liner 116 is also shown to include a polyolefin foam layer 150 below the layer 148, a foil layer 152 below the layer 150, a second polyester film layer 154 below the layer 152, and a heat seal layer 156 below the layer 154. The heat seal layer 156 is intended to at least partially melt to adhere to the bottle 102 during the described induction sealing process.

Referring now to FIGS. 7 through 11, the closure 118 is shown in further detail, according to an example embodiment. As shown, the closure 118 includes the side wall 132 (e.g., skirt, etc.) defining an outer periphery of the closure 118 and having an open bottom end configured to fit over the mouth 114 of the bottle 102. The closure 118 also includes an end wall positioned atop the side wall 132 to close a top end of the side wall 132 and form the top face 142 of the closure 118. According to one exemplary embodiment, side wall 132 is cylindrical in shape and has a coupling component (e.g., attachment structure), shown as threads 162 (see FIG. 11), located on an inside surface for engaging a corresponding coupling component (e.g., threads, etc.) on the bottle 102 to secure the closure 118 to the open end of the bottle 102. According to the various alternative embodiments, the coupling component may be any known or otherwise suitable structure (e.g., press-on rings or snap-fit structure, ribs, etc.) for coupling the closure 118 to the bottle 102.

Figure 8:
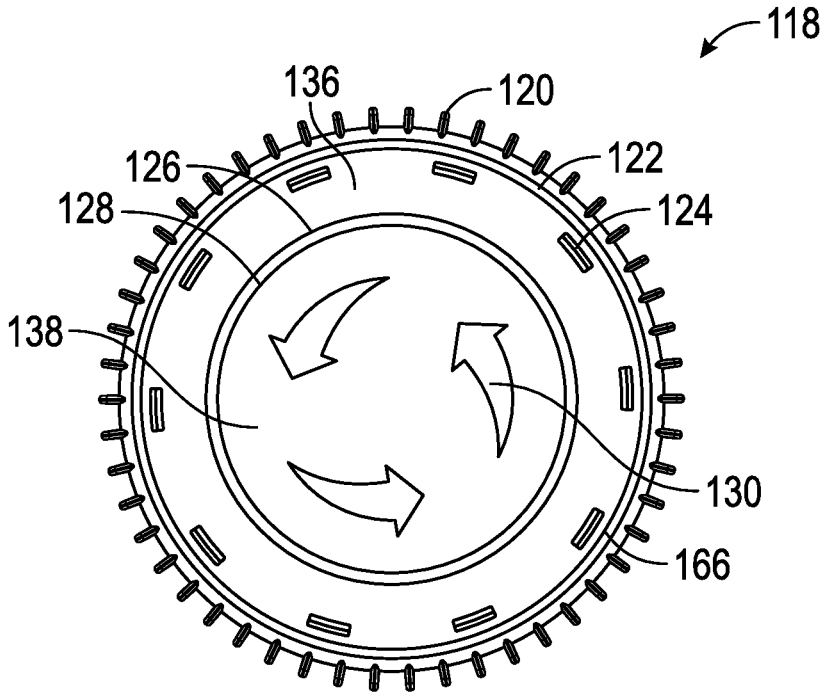
FIG. 8 is a top plan view of the closure, according to an example embodiment.
Figure 9:
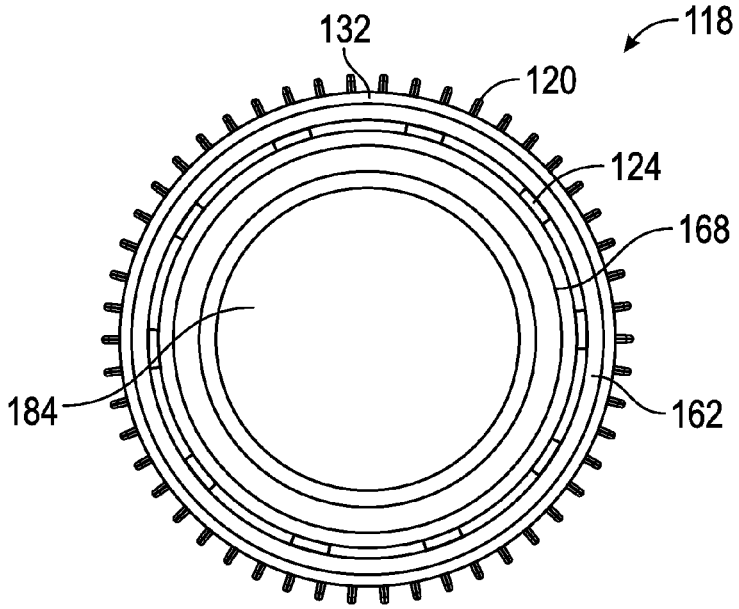
FIG. 9 is a bottom plan view of the closure, according to an example embodiment.
Figure 10:
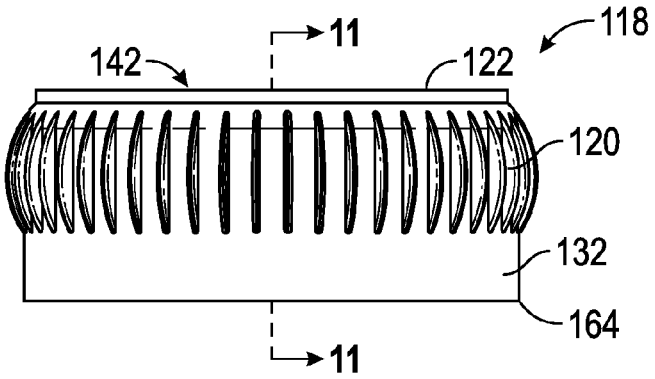
FIG. 10 is a side view of the closure, according to an example embodiment.

The side wall 132 is shown as extending continuously in a substantially vertical direction between a bottom edge 164 (e.g., a free end, etc.) of the side wall 132 and the top face 142 (or the rib 122) of the closure 118. The side wall 132 is also shown as including a gripping surface (e.g., a textured area, serrated area, ribs, etc.) provided by ribs 120. The ribs 120 are intended to facilitate gripping of the closure 118 by a user for rotating or otherwise moving the closure 118 relative to the bottle 102. According to the illustrated embodiment, the ribs 120 are adjacently spaced substantially around the entire periphery (e.g., outer perimeter) of the side wall 132. In an example embodiment, the ribs 120 may be integrally molded into the side wall 132. As shown in FIGS. 8 and 9, the ribs 120 may extend uniformly from the side wall 132 such that the gripping surface has a diameter greater than the diameter of the top face 142 or the rib 122. The gripping surface is formed by the outer surface of the ribs 120 away from the side wall 132. The ribs 120 have a rounded shape in the illustrated embodiment to enhance the gripping function of the ribs 120. The peak of each of the rounded ribs 120 may form the gripping surface for the closure 118.

According to an exemplary embodiment, the thickness of side wall 132 remains substantially constant from the top end (e.g., the end of the side wall 132 closest to the top face 142) to the bottom end (e.g., the end of the side wall 132 opposite the top end and closest to bottom edge 164) of the side wall 132. According to the various alternative embodiments, the thickness of the side wall 132 may reduce as the side wall 132 extends from the top end to the bottom end such that the thickness of the side wall 132 near its bottom end is less than the thickness of the side wall 132 near its top end. The reduction in the thickness of the side wall 132 as it extends away from the top face 142 (i.e., an end wall of the closure 118) may reduce the extent to which the closure 118 takes a noncircular or oval shape when it is removed from its mold. According to other alternative embodiments, the thickness of the side wall 132 may increase as it extends away from the top face 142 or may otherwise vary along the height of the side wall 132. According to an exemplary embodiment, the closure 118, including the side wall 132 and the top face 142, is integrally formed as a single unitary body in a single mold by an injection molding operation. According to the various alternative embodiments, components of the closure 118, including the side wall 132, the top face 142, and the ribs 120, may be formed separately and may be coupled together in any known or otherwise suitable manner (e.g., snap-fit, adhesive, welding, etc.).

Figure 7:
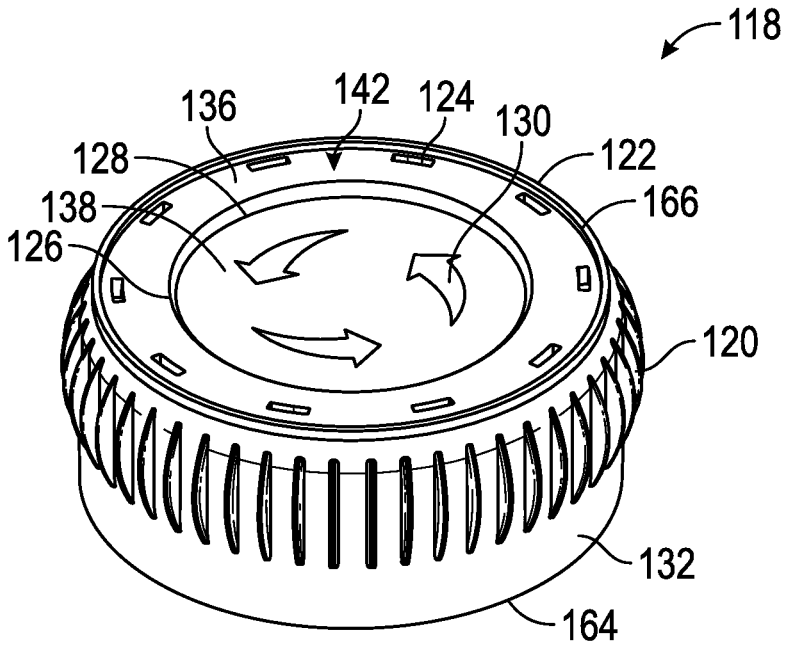
FIG. 7 is a perspective view of the closure, according to an example embodiment.
Figure 11:
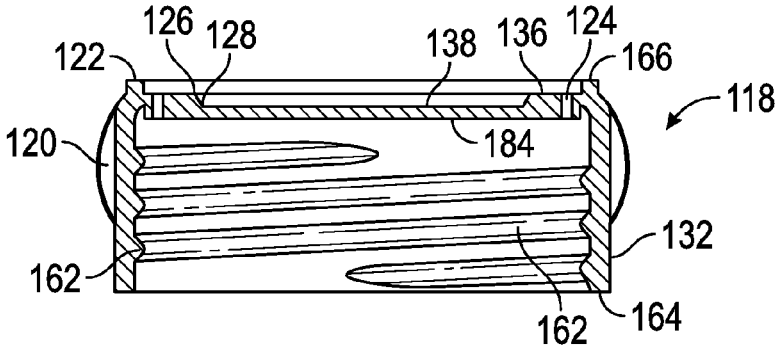
FIG. 11 is a cross-sectional view of the closure along the 11-11 line of FIG. 10, according to an example embodiment.

Referring particularly to FIGS. 7, 8, and 11, the rib 122 extends continuously around a perimeter of the closure 118 to at least partially enclose the top face 142. In the illustrated embodiment, the top face 142 of the closure 118 includes surfaces 136, 138, and 140. The surfaces 136, 138, and 140 may have varying heights relative to the rib 122. The surfaces 136, 138, and 140 may be provided at a height below the rib 122 such that air circulates in a space between the surfaces 136, 138, and 140 and the top surface of the rib 122 when a device providing pressurized air forms a seal with the rib 122. The surfaces 136, 138, and 140 are sized and shaped according to a shape of the closure 118. For instance, in the illustrated embodiment, the surfaces 136, 138, and 140 form concentric circles approximately matching the shape of the closure 118 and the rib 122. The surfaces 136, 138, and 140 are separated by concentric bands 126 and 128, which may be sloped to accommodate a difference in relative height between two of the bordering surfaces 136, 138, and 140.

Referring further to FIGS. 7, 8, and 11, the surface 136 is positioned adjacent to and within the rib 122, having an outer circumference approximately equal to an inner circumference of the rib 122. The surface 136 is positioned below the rib 122 (according to the upright orientation of the closure 118 shown in FIG. 7), such that the rib 122 extends vertically from the surface 136 to form a raised perimeter for the top face 142. The surface 136 forms a ring shape around the outer edge of the top face 142, bordered by the rib 122 and the band 126. The band 126 provides a border between the surface 136 and the surface 138. In the illustrated embodiment, the surface 138 is raised relative to the surface 136, but is still positioned below the rib 122 (according to the orientation of FIG. 7). In an example embodiment, the band 126 is sloped away from the surface 138 to the surface 136 to accommodate the difference in relative height. The slope of the band 126 and the lower relative height of the surface 136 may create a channel at the surface 136 between the rib 122 and the surface 138.

The openings 124 are formed through the top face 142 (i.e., the end wall of the closure 118) to fluidly connect to an air space between the closure 118 and the bottle 102. In an example embodiment, the openings 124 are formed entirely within the surface 136. The openings 124 may include one or more dimensions based on a dimension of the surface 136, the band 126, and/or the surface 138. For instance, in the illustrated embodiment the openings 124 are bordered by the annular band 126 and have a curved edge to approximate the curvature of the annular band 126. The openings 124 are shown to have a width that is smaller than the width of the surface 136, but in other embodiments the openings 124 may extend from the band 126 to the rib 122 within the surface 136. In an example embodiment, the rib 122 is diametrically disposed outboard of the openings 124. The openings 124 are shown to be approximately rectangular in shape, but may have another shape depending on the particular closure 118. The openings 124 may also be shaped according to an associated pressurized air device (e.g., fixture 200). The lower height of the surface 136 relative to the rib 122 and the surface 138 may form a channel for pressurized air to flow along the surface 136 and through the openings 124. In one embodiment, a pressurized air device may include a fixture configured to contact both the rib 122 and the surface 138, such that an airtight seal is formed on both sides of the surface 136 to create the air channel.

In an example embodiment, the surface 138 is approximately flat and is raised relative to the surface 136 but still positioned below the rib 122. The surface 138 may be raised relative to the surface 136 in order to direct air, liquid, and/or any debris toward the openings 124 to be flushed from the closure 118. The surface 138 has an annular ring shape concentric with the surface 136. In the illustrated embodiment, the surface 138 is positioned entirely within the surface 136, having a smaller radius but a greater width. A plurality of annular bands 128 provides a border between the surfaces 138 and 140. In an example embodiment, the surface 140 is approximately flat and positioned below the surface 138. The plurality of bands 128 may provide a slope or gradation between the relative height of the surface 138 and the surface 140. The surface 140 is positioned entirely within the surface 138, having a smaller radius than the surface 138. However, the surface 140 forms a circular shape rather than the hollow ring shapes of surfaces 136 and 138.

The top face 142 of the closure 118 also includes arrows 130 formed in the surface 140. The arrows 130 may provide an indication regarding the operation of the closure 118 and/or the container 100, including a direction of rotation to remove or attach the closure 118 to the bottle 102. The arrows 130 may also provide an indication of how the closure 118 and/or the container 100 were manufactured, or an indication of how the closure 118 and/or the container 100 are to be disposed. In other embodiments, the surfaces 136, 138, and 140 may include other similar indicators intended to assist a user in an operation associated with the closure 118. For instance, the closure 118 may include indicators at the rib 122, the surface 136, and/or the openings 124 to assist in placing an associated pressurized air device to flush debris from beneath the closure 118.

Referring particularly to FIG. 9, an underside of the closure 118 is shown more particularly, according to an example embodiment. The side wall 132 of the closure 118 is shown to have a substantially circular shape and a substantially uniform thickness around its entirety. As shown in FIG. 9, the openings 124 extend from the top surface 136 of the closure 118 and through the inner surface 184. Although the inner surface 184 is shown in the example embodiment, in other embodiments the liner 116 may be attached to the inner surface 184 of the closure 118 such that the inner surface 184 is substantially covered. The inner surface 184 may become exposed after the liner 116 is adhered to the bottle 102 as described herein. When the liner 116 is adhered to the bottle 102, air may be sent through the openings 124 and through the inner surface 184 to force remaining product or other debris that collects underneath the closure 118 to an area outside of the closure 118. For instance, debris that collects between the closure 118 and the bottle 102 may be forced out from under the closure 118 (i.e., via air forced through the openings 124 and as otherwise described herein) to the ledge 134 of the bottle 102 so that the debris may be wiped away.

The inner surface 184 is shown to include a circular band 168 disposed diametrically inboard of the openings 124. In an example embodiment, the band 168 is shaped according to the lip 176 of the bottle 102 and configured to interface with the lip 176 when the closure 118 is coupled to the bottle 102 to seal the bottle 102. The band 168 may be raised relative to other portions of the inner surface 184 in order to meet the lip 176.

It is also important to note that the construction and arrangement of the elements of the container as shown in the exemplary embodiment is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements and those shown a multiple parts may be integrally formed. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

Before discussing further the details of the closure and components thereof, it should be noted at the outset that references to "front," "back," "rear," "upper," "lower," "right," and "left" in this description are merely used to identify the various elements as they are oriented in the FIGURES, with "front," "back," and "rear" being relative to the position of the closure when secured to a container. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

What is claimed is:

1. A closure configured to fit over a mouth of a receptacle to form a container, the closure comprising:

a skirt defining an outer periphery of the closure and having an open bottom end configured to fit over the mouth of the receptacle;

an end wall positioned atop the skirt to close a top end of the skirt and form a top face of the closure;

one or more openings formed through the end wall, wherein the one or more openings provide an air passage to a space between the skirt and the mouth of the receptacle; and a sealing rib formed on the top face and diametrically disposed outboard the one or more openings, wherein the sealing rib is raised from the top face such that the one or more openings are positioned below a top surface of the sealing rib, wherein the top surface of the sealing rib is substantially flat and configured to interface with a corresponding surface of a sealing device to substantially seal an air space formed at least partially by the sealing rib and the raised top surface;

so that when the air space is sealed at the sealing rib, air sent into the air space is forced through the air passage provided by the one or more openings and through the space between the skirt and the mouth of the receptacle.

2. The closure of claim 1, wherein, the air sent into the air space and through the one or more openings exits out of the closure through the open bottom end.

3. The closure of claim 2, wherein the one or more openings are equally spaced around the perimeter formed by the sealing rib to force air received from the air space substantially evenly around and within the skirt through the open bottom end.

4. The closure of claim 1, further comprising:

an induction liner removably attached to the end wall and configured to detach from the end wall to hermetically seal the mouth of the receptacle when the closure is coupled to the receptacle and adequate heat is applied to the induction liner.

5. The closure of claim 1, wherein the skirt includes outer ribs equally spaced around the outer periphery of the skirt and providing frictional faces to increase an applied torque resulting from a rotational force applied by a user of the closure.

6. A closure configured to fit over a mouth of a receptacle to form a container, the closure comprising:

a skirt defining an outer periphery of the closure and having an open bottom end configured to fit over the mouth of the receptacle;

an end wall positioned atop the skirt to close a top end of the skirt, the end wall having a first side forming a top face of the closure and a second side forming an inner surface;

one or more openings formed through the end wall;

an induction liner substantially covering the inner surface and configured to detach from the inner surface to hermetically seal the mouth of the receptacle when the closure is coupled to the receptacle and adequate heat is applied to the induction liner; and a sealing rib formed on the top face and diametrically disposed outboard the one or more openings.

7. The closure of claim 6, wherein the one or more openings provide an air passage to a space between the skirt and a portion of the receptacle.

8. The closure of claim 6, wherein the sealing rib is raised from the top face such that the one or more openings are positioned below a top surface of the sealing rib and within a perimeter formed by the sealing rib, wherein the top surface of the sealing rib is substantially flat and configured to interface with a corresponding surface of a sealing device to substantially seal an air space formed between the top face and the raised top surface.

9. The closure of claim 8, wherein, when the air space is sealed at the sealing rib, air sent into the air space is forced through an air passage provided by the one or more openings and out of the closure through the open bottom end.

10. The closure of claim 9, wherein the one or more openings are equally spaced around the perimeter formed by the sealing rib to force air received from the air space substantially evenly around and within the skirt through the open bottom end.

11. The closure of claim 6, wherein the skirt includes outer ribs equally spaced around the outer periphery of the skirt and providing frictional faces to increase an applied torque resulting from a rotational force applied by a user to the closure.

12. A container for storing dispensable contents, the container comprising:

a receptacle having a neck forming an open mouth; and a closure removably coupled to the receptacle to substantially cover the open mouth, the closure comprising:

a skirt defining an outer periphery of the closure and having an open bottom end configured to fit over the mouth of the receptacle;

an end wall positioned atop the skirt to close a top end of the skirt and form a top face of the closure;

one or more openings formed through the end wall;

an induction liner removably attached to the end wall and configured to hermetically seal the open mouth of the receptacle when adequate heat is applied to the induction liner; and a sealing rib formed on the top face and diametrically disposed outboard the one or more openings;

wherein the sealing rib is raised from the top face such that the one or more openings are positioned below a top surface of the sealing rib.

13. The container of claim 12, wherein the one or more openings provide an air passage to a space between the skirt and the neck of the receptacle.

14. The container of claim 12, wherein the top surface of the sealing rib is substantially flat and configured to interface with a corresponding surface of a sealing device to substantially seal an air space formed between the top face and the raised top surface.

15. The container of claim 14, wherein, when the air space is sealed at the sealing rib, air sent into the air space is forced through an air passage provided by the one or more openings, between the neck of the receptacle and the skirt of the closure, and out of the closure through the open bottom end.

16. The container of claim 15, wherein the one or more openings are equally spaced around the perimeter formed by the sealing rib to force air received from the air space substantially evenly around the skirt between the skirt and the neck, and through the open bottom end.

17. The container of claim 15, wherein the receptacle includes a continuous ledge formed around the neck, wherein the ledge extends from the neck and directly below the skirt to collect any debris forced from underneath the closure via the one or more openings.

18. The container of claim 12, wherein the skirt includes outer ribs equally spaced around the outer periphery of the skirt and providing frictional faces to increase an applied torque resulting from a rotational force applied by a user to the closure.

19. The container of claim 12, wherein the one or more openings are diametrically disposed at least partially outboard of an outer edge of the open mouth.

* * * * *